US011690434B2

(12) United States Patent
Tuttle

(10) Patent No.: US 11,690,434 B2
(45) Date of Patent: Jul. 4, 2023

(54) DEVICE FOR APPLYING AND REMOVING NAIL POLISH

(71) Applicant: OJIP, LLC, Los Angeles, CA (US)

(72) Inventor: Sarah Gibson Tuttle, Los Angeles, CA (US)

(73) Assignee: OJIP, LLC, Los Angeles, CA (US)

( * ) Notice: Subject to any disclaimer, the term of this patent is extended or adjusted under 35 U.S.C. 154(b) by 374 days.

(21) Appl. No.: 16/603,733

(22) PCT Filed: Apr. 10, 2018

(86) PCT No.: PCT/US2018/026818
§ 371 (c)(1),
(2) Date: Oct. 8, 2019

(87) PCT Pub. No.: WO2018/191218
PCT Pub. Date: Oct. 18, 2018

(65) Prior Publication Data

US 2020/0054108 A1 Feb. 20, 2020

Related U.S. Application Data

(60) Provisional application No. 62/484,289, filed on Apr. 11, 2017.

(51) Int. Cl.
*A45D 29/00* (2006.01)
*A45D 34/04* (2006.01)
*A45D 29/12* (2006.01)

(52) U.S. Cl.
CPC ..... *A45D 29/12* (2013.01); *A45D 29/007* (2013.01); *A45D 34/04* (2013.01); *A45D 34/042* (2013.01);
(Continued)

(58) Field of Classification Search
CPC ..... A45D 29/11; A45D 29/12; A45D 29/007; A45D 29/00; A45D 2200/25;
(Continued)

(56) References Cited

U.S. PATENT DOCUMENTS 1,188,394 A * 6/1916 Bernstein ..... B43K 5/18 401/230
2,268,740 A 1/1942 Cory
(Continued)

FOREIGN PATENT DOCUMENTS

CH 89341 A * 5/1921 ..... A45D 34/042
DE 202010013587 U1 * 1/2012 ..... A45D 34/04
(Continued)

OTHER PUBLICATIONS

Olive and June, "Bootcamp Day 2: Painting with Beginner Shades | Olive & June", youtube, Jul. 19, 2022 (Year: 2022).*
(Continued)

*Primary Examiner* — Jacqueline T Johanas
*Assistant Examiner* — Sarah Woodhouse
(74) *Attorney, Agent, or Firm* — Knobbe, Martens, Olson & Bear, LLP

(57) ABSTRACT

A device for applying or removing nail polish or nail art has a replaceable cartridge with a distal end removably coupleable to a proximal end of a handle. The cartridge has a reservoir that contains a liquid, such as nail polish or nail polish remover and a flow control member (e.g., valve) actuatable to allow flow of the liquid out of the distal end of the cartridge. The handle has a flow path therethrough that extends between its proximal end to an applicator implement (e.g., brush, sponge) attached to its distal end, the flow path in fluid communication with the flow control member when the cartridge is coupled to the handle. Selective actuation of the flow control member by the user (e.g., by squeezing the
(Continued)

cartridge) allows fluid to flow out the reservoir and through the flow path in the handle to the applicator implement for application of the fluid by the user to a finger or toe nail.

15 Claims, 6 Drawing Sheets

(52) U.S. Cl.
CPC .. *A45D 2029/005* (2013.01); *A45D 2200/052* (2013.01); *A45D 2200/054* (2013.01); *A45D 2200/1045* (2013.01); *A45D 2200/1063* (2013.01); *A45D 2200/25* (2013.01)

(58) Field of Classification Search
CPC ..... A45D 2200/1063; A45D 2200/10; A45D 2200/1009; A45D 2200/052; A45D 2200/054; A45D 2029/005; A45D 2200/1045; A61J 1/067
USPC ..... 132/74.5, 73, 73.5, 75
See application file for complete search history.

(56) References Cited

U.S. PATENT DOCUMENTS 2,717,727 A * 9/1955 Robb ..... B65D 47/261 222/215
3,341,884 A 9/1967 Pryor
D216,777 S 3/1970 Nelson
4,040,753 A * 8/1977 Griffith ..... A45D 34/042 401/186
4,627,758 A 12/1986 Winthrop
4,748,990 A * 6/1988 Brown ..... A45D 34/042 401/277
5,063,057 A * 11/1991 Spellman ..... A61Q 5/02 424/456
D328,654 S 8/1992 Mizobata et al.
5,470,162 A * 11/1995 Rubin ..... B43K 7/005 D19/178
5,762,077 A 6/1998 Griffiths
5,887,753 A 3/1999 Poolman
5,908,256 A * 6/1999 Bernstein ..... A45D 34/04 401/23
6,004,055 A 12/1999 Cheng
6,062,229 A * 5/2000 Kandratavich ..... A46B 13/04 132/73
6,302,607 B1 * 10/2001 Burrowes ..... A45D 34/04 401/23
6,328,040 B1 12/2001 Stein
6,343,885 B1 * 2/2002 Heyne ..... B43K 23/04 401/48
6,357,631 B1 * 3/2002 Zaksenberg ..... B65D 75/5811 222/215
D461,596 S 8/2002 Angeletta
6,505,986 B1 * 1/2003 Oder ..... A45D 24/26 222/211
D473,793 S 4/2003 Paster
6,679,439 B2 * 1/2004 Duqueroie ..... B05B 11/048 239/323
6,715,697 B2 * 4/2004 Duqueroie ..... B05B 11/048 239/326
6,745,781 B2 * 6/2004 Gueret ..... B65D 83/285 401/266
D499,207 S 11/2004 Angeletta
6,860,404 B2 * 3/2005 Duqueroie ..... B05B 11/043 222/211
6,945,473 B2 * 9/2005 Garcia ..... A61L 9/12 239/326
D514,939 S 2/2006 Miozzo et al.
D544,350 S 6/2007 Mettler et al.
D547,189 S * 7/2007 Legros ..... D9/521
D562,152 S 2/2008 Beam et al.
D563,238 S * 3/2008 Nevins ..... D9/684
D564,308 S * 3/2008 Brunner ..... D7/669
D580,598 S 11/2008 Yamada et al.
D581,280 S 11/2008 Oates
7,690,536 B2 * 4/2010 Briozzo Fernandez ..... B05B 7/0037 222/211
D616,307 S * 5/2010 Legros ..... D9/454
D657,252 S 4/2012 Crapser et al.
D675,939 S * 2/2013 Van Gogh ..... D9/540
D680,265 S 4/2013 DeMarco et al.
D708,065 S 7/2014 Pourian
D735,406 S 7/2015 Poletto
D752,987 S 4/2016 Dyer et al.
D753,402 S 4/2016 Telwar
9,462,917 B2 * 10/2016 Licari ..... A47K 5/12
9,737,126 B1 * 8/2017 Fishman ..... A45D 34/042
9,763,508 B2 9/2017 Reishus et al.
D803,063 S * 11/2017 Matuszczak ..... D9/571
D812,809 S 3/2018 Nicoline
D826,473 S 8/2018 Pires et al.
D827,442 S 9/2018 Stone et al.
10,092,077 B1 * 10/2018 Tuttle ..... A45D 34/04
D841,234 S 2/2019 Laaly
10,306,969 B1 * 6/2019 Laaly ..... A45D 29/00
D854,242 S 7/2019 Tuttle
D911,601 S * 2/2021 Tuttle ..... D28/7
D930,239 S 9/2021 Tuttle
11,331,784 B2 * 5/2022 Dyer ..... B43K 23/008
2002/0104856 A1 * 8/2002 Clark ..... A61J 7/0053 222/630
2003/0081982 A1 * 5/2003 Dumler ..... A45D 40/26 401/125
2003/0152411 A1 * 8/2003 Prokopos ..... A45D 34/042 401/117
2004/0071493 A1 4/2004 Hendrix-Stavropoulos
2005/0025557 A1 * 2/2005 De LaForcade ..... B65D 1/32 401/129
2005/0072441 A1 * 4/2005 Lee ..... A45D 29/14 132/74.5
2006/0140708 A1 * 6/2006 Byun ..... A46B 11/0089 401/269
2006/0289537 A1 * 12/2006 Ficcadenti ..... B65D 21/0219 220/4.27
2007/0172305 A1 * 7/2007 Altonen ..... A45D 34/04 401/262
2008/0223875 A1 * 9/2008 LaFlamme ..... B65D 81/3261 222/207
2008/0271320 A1 * 11/2008 Brunner ..... A47J 21/00 30/113.1
2008/0271321 A1 * 11/2008 Brunner ..... A47J 21/00 30/113.1
2009/0214283 A1 * 8/2009 Thiebaut ..... A45D 2/48 53/235
2010/0168637 A1 * 7/2010 Casey ..... A61M 35/003 401/133
2011/0066121 A1 * 3/2011 Hoang ..... A61M 35/003 29/428
2011/0286782 A1 * 11/2011 Castellani ..... B65D 23/12 401/125
2012/0048290 A1 3/2012 Cappello
2013/0028651 A1 * 1/2013 Kaufman ..... A61L 2/00 401/133
2013/0108350 A1 * 5/2013 Ulrich ..... A45D 33/02 222/135
2013/0243514 A1 * 9/2013 Ballot ..... B05C 1/00 401/109
2013/0292414 A1 * 11/2013 Sutherland ..... A47K 5/122 222/107
2014/0133895 A1 * 5/2014 Dockery ..... A45D 40/24 401/6
2014/0228785 A1 * 8/2014 Soil ..... A61J 1/062 604/310
2014/0373860 A1 12/2014 Hwang
2015/0100002 A1 4/2015 Choi
2015/0110542 A1 * 4/2015 Lee ..... A45D 34/042 401/186
2016/0095415 A1 4/2016 Nakajima et al.

(56) References Cited

U.S. PATENT DOCUMENTS

| | | | | |
|---|---|---|---|---|
| 2016/0143415 | A1* | 5/2016 | Laaly | A45D 34/042 401/193 |
| 2017/0112260 | A1* | 4/2017 | Stanton | A45D 34/042 |
| 2017/0303658 | A1 | 10/2017 | Becker | |
| 2019/0029393 | A1* | 1/2019 | Chung | G01F 11/025 |
| 2019/0038001 | A1* | 2/2019 | Legastelois | A45D 34/00 |
| 2019/0269221 | A1* | 9/2019 | Jung | A45D 40/26 |

FOREIGN PATENT DOCUMENTS

| | | | | |
|---|---|---|---|---|
| DE | 102012214111 | A1 * | 5/2014 | A61J 1/067 |
| DE | 102016222682 | B3 * | 10/2017 | B05B 1/3093 |
| EP | 1384416 | | 1/2004 | |
| FR | 3026614 | A1 | 4/2016 | |
| FR | 3047648 | A1 * | 8/2017 | A45D 34/00 |
| GB | 2351272 | A * | 12/2000 | A61J 7/0023 |
| JP | 1647488 | | 12/2019 | |
| JP | 1656509 | S | 4/2020 | |
| KR | 20-0367470 | Y1 | 11/2004 | |
| KR | 10-2005-0031897 | A | 4/2005 | |
| KR | 1272628 | B1 * | 6/2013 | A45D 33/36 |
| KR | 301070994.0000 | | 8/2020 | |
| WO | WO-9630272 | A1 * | 10/1996 | A61J 1/067 |
| WO | WO 01/01813 | A1 | 1/2001 | |
| WO | WO 03/003873 | A1 | 1/2003 | |
| WO | WO-03003873 | A1 * | 1/2003 | A45D 34/042 |
| WO | WO-03055435 | A1 * | 7/2003 | A61J 7/0023 |
| WO | WO 2004/062422 | A1 | 7/2004 | |
| WO | WO 2018-005504 | | 1/2018 | |

OTHER PUBLICATIONS

Notice of Allowance dated Oct. 18, 2019 in Japanese Patent Application No. 2019-007452; 5 pages.

Amethyst [online], [site viited Oct. 8, 2020]. Available from internet, URL:<https://shop.miniluxe.com/prducts/ametheyst?gclid-Cj0KCQjw8fr7BRDSARIsAKOQqr4RvkzRA_8DBtj9Kgeg1glD4aPVfFf9w56W7x1vEVMRnGg_QkVSFIMaAuQTEALw_wcB> (Year: 2020).

Decision of Registration dated Feb. 18, 2020 in Japanese Patent Application No. 2019-022246; 9 pages.

PCT Written Opinion and Search Report dated Aug. 2, 2018 regarding International Application No. PCT/US2018/026818 (12 pages).

The Poppy, announced 2019 [online], [site visited Oct. 8, 2020]. Available from internet, URL:,https://oliveandjune.com/products/the-poppy> (Year: 2019).

International Search Report and Written Opinion dated Aug. 2, 2018 regarding International Application No. PCT/US2018/026818 (12 pages).

* cited by examiner

DEVICE FOR APPLYING AND REMOVING NAIL POLISH

CROSS-REFERENCE TO RELATED APPLICATIONS

This application is a National Phase Application of PCT International Application Number PCT/US2018/026818, filed Apr. 10, 2018, which claims priority to U.S. Provisional Application No. 62/484,289, filed Apr. 11, 2017, the entirety of each of which is incorporated by reference herein. Any and all applications for which a foreign or domestic priority claim is identified in the Application Data Sheet as filed with the present application are hereby incorporated by reference under 37 CFR 1.57, and should be considered a part of this specification.

BACKGROUND

Field

Aspects of the present disclosure are directed to a device for applying and removing nail polish and/or nail art.

Description of the Related Art

Nail polish applicators are usually provided within the bottle containing the nail polish (e.g., attached to a stem that extend from the underside of the cap of the bottle. However, such applicators have several draw backs. For example, they are only associated with the particular liquid (e.g., nail polish) in the corresponding bottle. Additionally, the whole applicator is inserted into the bottle, not just the brush at the end of the stem, there may inadvertent dripping of nail polish. More recently, applying nail art has become popular, which can include applying a variety of colors, glitters, patterns and/or textures.

Further, to remove nail polish, a separate applicator is used to apply the remover (e.g., acetone, ethyl acetate).

SUMMARY

Accordingly, there is a need for an improved device for applying and removing nail polish, nail art, etc. to and from nails. Disclosed herein are embodiments of applicator designs that can be utilized to apply and/or remove nail polish and nail art from a user's nails. Advantageously, the applicator designs overcome at least some of the drawbacks of existing applicators discussed above.

In accordance with one aspect, a device for applying or removing nail polish or nail art on a finger or toe nail is provided. The device comprises a cartridge of resilient material having a reservoir therein that contains a fluid chosen from a group consisting of nail polish or nail polish remover. The cartridge is configured to allow flow of the fluid through a flow control member proximal a distal end of the cartridge. The device also comprises a handle extending between a proximal end and a distal end, the proximal end of the handle configured to removably couple to the distal end of the cartridge. The handle has a flow path that extends between the proximal and distal ends of the handle and is in fluid communication with the flow control member when the cartridge is coupled to the handle so that flow of fluid from the reservoir is configured to flow through the flow path in the handle. The device also comprises an applicator head having a support base attached to the distal end of the handle and an applicator implement at a distal end of the applicator head. The support base has a flow path that extends through the support base to the applicator implement and is in fluid communication with the flow path in the handle so that flow of fluid through the handle flows through the support base to the applicator implement. Selective actuation of the cartridge or handle by the user allows a volume of fluid to flow out the cartridge through the flow control member and into the flow path in the handle, said fluid flowing from the handle though the flow path in the support base to the applicator implement for application of the fluid by the user to a finger or toe nail.

In another aspect a device for applying or removing nail polish or nail art on a finger or toe nail is provided. The device comprises a cartridge of resilient material having a reservoir therein that contains a fluid chosen from a group consisting of nail polish or nail polish remover. The cartridge has a concave contoured top surface configured to receive a user's finger thereon and a convex contoured bottom surface configured to receive a user's finger thereon, the cartridge having a valve actuatable to allow flow of the fluid out of a distal end of the cartridge. The device also comprises a handle extending between a proximal end and a distal end, the proximal end of the handle configured to removably couple to the distal end of the cartridge. The handle has a contoured body comprising a contoured top surface that substantially aligns with the concave contoured top surface of the cartridge. The handle also has a contoured bottom surface that substantially aligns with the convex contoured bottom surface of the cartridge so that the handle and cartridge together define a contoured body that facilitates the holding of the cartridge and handle by the user. The handle has a flow path that extends between the proximal and distal ends of the handle and is configured to receive the fluid dispensed via the valve when the cartridge is coupled to the handle, an applicator implement operatively coupled to the distal end of the handle so that flow of fluid through the handle flows to the applicator implement. Selective actuation of the cartridge by the user allows a volume of fluid to flow out the cartridge through the valve and through the flow path in the handle to the applicator implement for application of the fluid by the user to a finger or toe nail.

In accordance with another aspect, a kit for applying or removing nail polish or nail art on a finger or toe nail is provided. The kit comprises one or more replaceable cartridges of resilient material having a reservoir therein that contains a fluid chosen from a group consisting of nail polish or nail polish remover. Each cartridge has a concave contoured top surface configured to receive a user's finger thereon and a convex contoured bottom surface configured to receive a user's finger thereon. Each cartridge has a flow control member actuatable to allow flow of the fluid out of a distal end of the cartridge. The kit also comprises a handle having a contoured body extending between a proximal end and a distal end, the proximal end of the handle configured to removably couple to the distal end of the cartridge. The handle has a flow path that extends between the proximal and distal ends of the handle and is in fluid communication with the flow control member when the cartridge is coupled to the handle so that flow of fluid from the reservoir is configured to flow through the flow path in the handle. An applicator implement is operatively coupled to the distal end of the handle so that flow of fluid through the handle flows to the applicator implement. The one or more replaceable cartridges are each configured to removably couple to the proximal end of the handle, and wherein selective actuation of the cartridge by the user allows a volume of fluid to flow out the cartridge through the flow control member and through the flow path in the handle to the applicator implement for application of the fluid by the user to a finger or toe nail.

DETAILED DESCRIPTION

Figure 2:
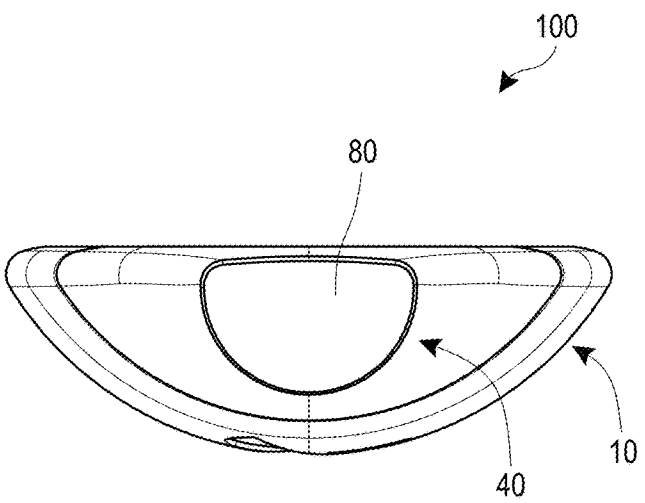
FIG. 2 is a schematic front view of a device for applying or removing nail polish or nail art.
Figure 1:
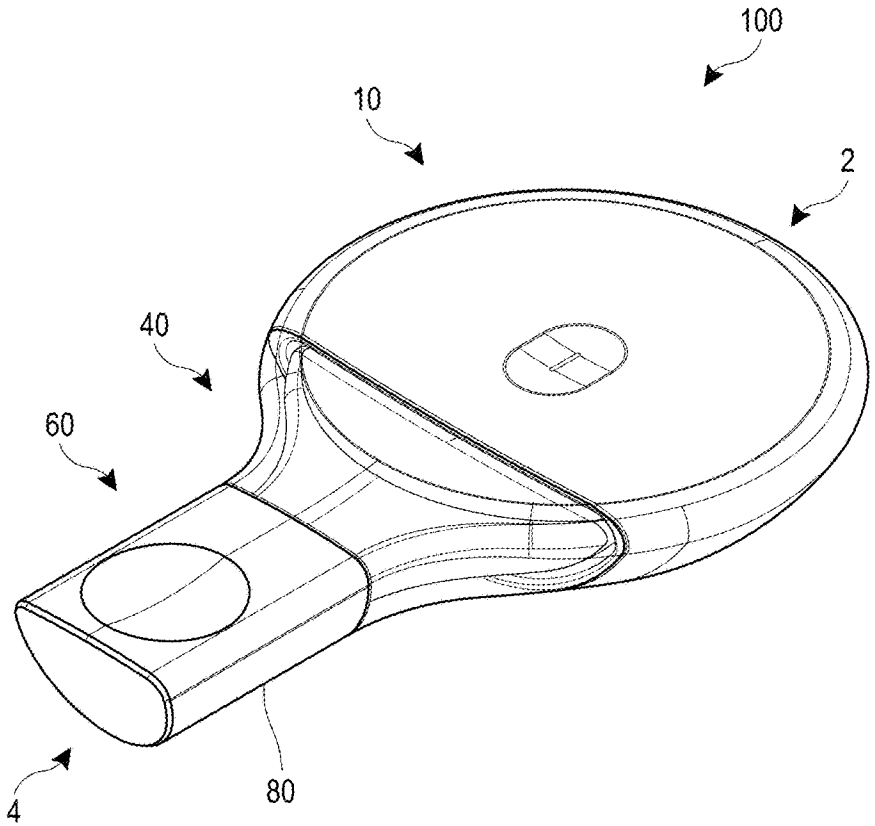
FIG. 1 is a schematic perspective top view of a device for applying or removing nail polish or nail art.

Disclosed herein are several embodiments of a device (e.g., tool) for applying and/or removing nail polish and/or nail art (e.g., applicator device). The device can be handheld. In some embodiments, the same device can be used for application of one or more substances (e.g. nail polish, paint, glitter, nail art) as well as for the removal of said one or more substance (e.g., via application of nail polish remover). The applicator device can have shapes other than the shapes described below. The applicator device can be made of any suitable material (e.g., plastic, metal, etc.). The applicator can be made via using a suitable process, such as molding, casting, etc.

FIGS. 1-8 shows an applicator device 100 for applying a substance (e.g., nail polish, nail art, nail polish remover) to a nail (finger or toe nail) of a user's finger(s) and/or toe(s). The device 100 can have extend between a proximal end 2 and a distal end 4. The device 100 has a reservoir 10 at the proximal end 2, an applicator head 60 at the distal end 4, and a handle 40 interposed between the reservoir 10 and the applicator head 60. Optionally, a cap 80 can removably cover the applicator head 60.

The reservoir 10 can hold a substance (e.g., nail polish, nail polish remover, nail art, etc.) that can be delivered through the handle 40 to the applicator head 60 for application on a user's finger and/or toe nails. Optionally, the reservoir 10 can be in a detachable cartridge 20 that removably couples to a proximal end 42 of the handle 40, as further described below. Alternatively, the reservoir 10 and handle 40 can be a single piece (e.g., monolithic, seamless piece). Optionally, the head 60 can removably couple to a distal end 44 of the handle 40, as further described below. Alternatively, the handle 40 and applicator head 60 can be a single piece (e.g., monolithic, seamless piece). In one variation, the reservoir 10, handle 40 and head 60 are a single piece (e.g., monolithic, seamless piece). In another variation, at least one of the reservoir 10 and applicator head 60 are removably coupleable to the handle 40. In another variation, both the reservoir 10 and applicator head 60 are removably coupleable to the handle 40. Optionally, the reservoir 10 is refillable (e.g., via a removable cap, or via the flow control member 30) by a user.

Figure 7:
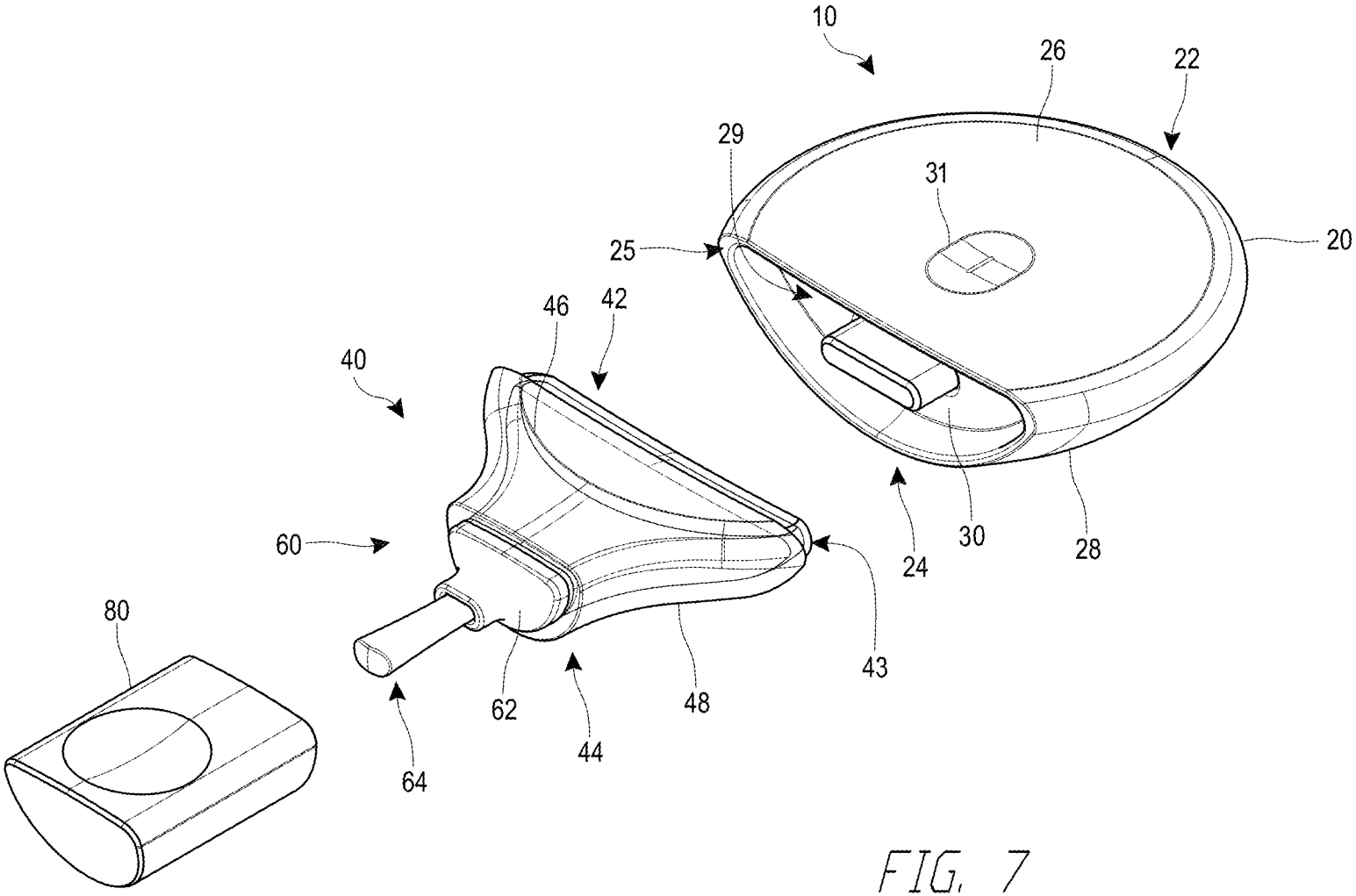
FIG. 7 is a schematic perspective exploded view of a device for applying or removing nail polish or nail art.

As best shown in FIG. 7, in one variation the reservoir 10 is defined in a detachable cartridge 20 that removably couples to the proximal end 42 of the handle 40. The cartridge 20 optionally has a contoured body that extends between a proximal end 22 and a distal end 24. Optionally, the proximal end 22 is curved and the distal end 24 has an opening 25 sized to receive a lip 43 of the proximal end 42 of the handle 40. The cartridge 20 optionally has a contoured (e.g., concave) top surface 26 and a contoured (e.g., convex or domed) bottom surface 28 that advantageously allows a user to comfortable hold the cartridge, on its own or when attached to the handle 40. Advantageously, the contoured (e.g., concave) top surface 26 can optionally receive the user's thumb thereon and the contoured (e.g., convex, domed) bottom surface 28 can optionally receive one or more of the user's index, middle and ring fingers thereon, allowing the user to comfortably hold the cartridge in their hand (e.g., with the index, middle and/or ring fingers flexed so that the fingers contact a greater surface area of the bottom surface 28). Additionally, the curved proximal end 22, can optionally comfortably fit against the user's palm while holding the cartridge with their hand.

Optionally, the cartridge 20 removably couples to the handle 40 via a press-fit connection. In another variation, the cartridge 20 can removably couple to the handle 40 via a threaded connection. In still another variation, the cartridge 20 can removably couple to the handle 40 via a key-slot connection. In still another variation, the cartridge 20 can removably couple to the handle 40 via a snap-fit mechanism; for example, one of the distal end 24 of the cartridge 20 and the proximal end 42 of the handle 40 can have a ridge or protrusion that snaps or clips into a groove or recess on the other of the distal end 24 of the cartridge 20 and the proximal end of the handle 40.

Optionally, the cartridge 20 has a window 31, allowing the user to view the inside of the reservoir 10. The window advantageously allows the user to readily identify the contents in the reservoir 10 (e.g., the color nail polish, type of nail art, etc.). Additionally, the window 31 allows the user to readily identify the level of fluid in the reservoir 10 and determine whether its contents are almost depleted such that a change in cartridge will be required.

With continued reference to FIG. 7, the distal end 24 of the cartridge 20 can have a recess 29 that is at least partially defined by the opening 25, and can have a flow control member 30 disposed in the recess 29. Optionally, the flow control member 30 includes a flow control valve (e.g., one-way valve, needle valve, check valve, flap valve) that selectively allows the liquid (e.g., nail polish, nail art, nail polish remover) to flow from the reservoir 10 through the flow control member 30 and into the handle 40, as further described below. For example, the flow control member 30 can be made of a flexible material (e.g., rubber, plastic) and have one or more walls with a flap valve defined therein so that when the cartridge 20 is squeezed, the flow control member 30 is flexed and the flap valve opens to allow flow from the reservoir 10 therethrough, and when the cartridge 20 is not squeezed the flow control member 30 can unflex to its default orientation with the flap valve closed to inhibit flow from the reservoir 10. Optionally, the flow control member 30 can be moved from a closed position that inhibits flow from the reservoir 10 to an open position that allows flow from the reservoir 10. Optionally, the flow control member 30 is spring loaded and biased toward the closed position. Optionally, when the cartridge 20 is coupled to the proximal end 42 of the handle 40, a feature in the handle can press against the flow control member 30 to move it to the open position to allow flow of liquid from the reservoir 10 into the handle 40. In another variation, the flow control member 30 can include a button that can be pressed by a user, or pivotable lever that can be pivoted between two or more positions by the user, or slidable tab that can be slid between two or more positions by the user, on one of the cartridge 20 and handle 40 that can be selectively actuated by the user to open or close the reservoir 10 to fluid flow. In one variation, an actuator (e.g., on the handle 40) can be actuated (e.g., depressed, slid, pivoted) to eject the cartridge 20 from the device 100.

Optionally, the flow control member 30 can have a flow metering control that allows a predetermined amount of fluid to flow from the reservoir 10. In one variation, the flow control member 30 can include a check valve or one-way valve or flap valve that can be actuated by the user. For example, the user can squeeze the cartridge 20 (e.g., press on the top surface 26 and bottom surface 28 with their fingers), which can cause a flexible check valve or one-way valve to one to allow fluid flow from the reservoir 10 (e.g., as long as the cartridge 20 is squeezed). Once the user stops squeezing the cartridge 20, the flexible check valve or one-way valve can move to a closed position to disallow further flow from the reservoir 10 (e.g., until the cartridge 20 is squeezed again).

Figure 4:
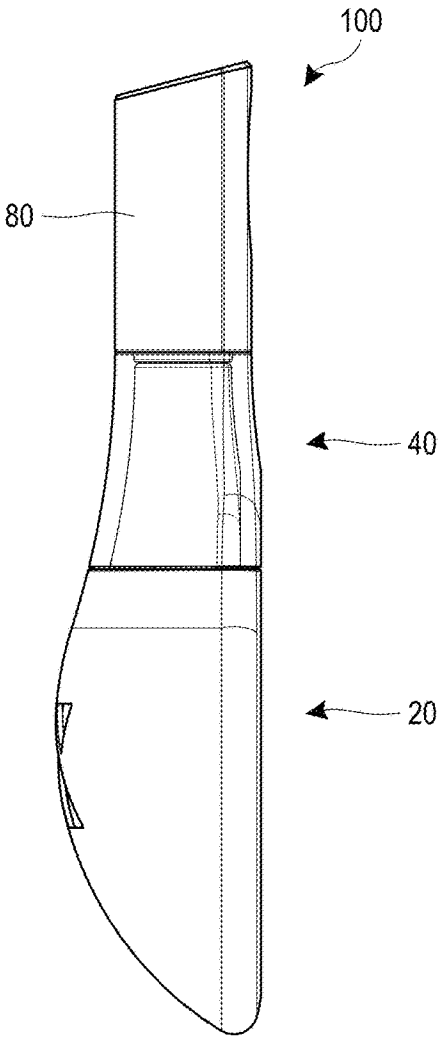
FIG. 4 is a schematic left side view of a device for applying or removing nail polish or nail art, the right side view being a mirror image.
Figure 3:
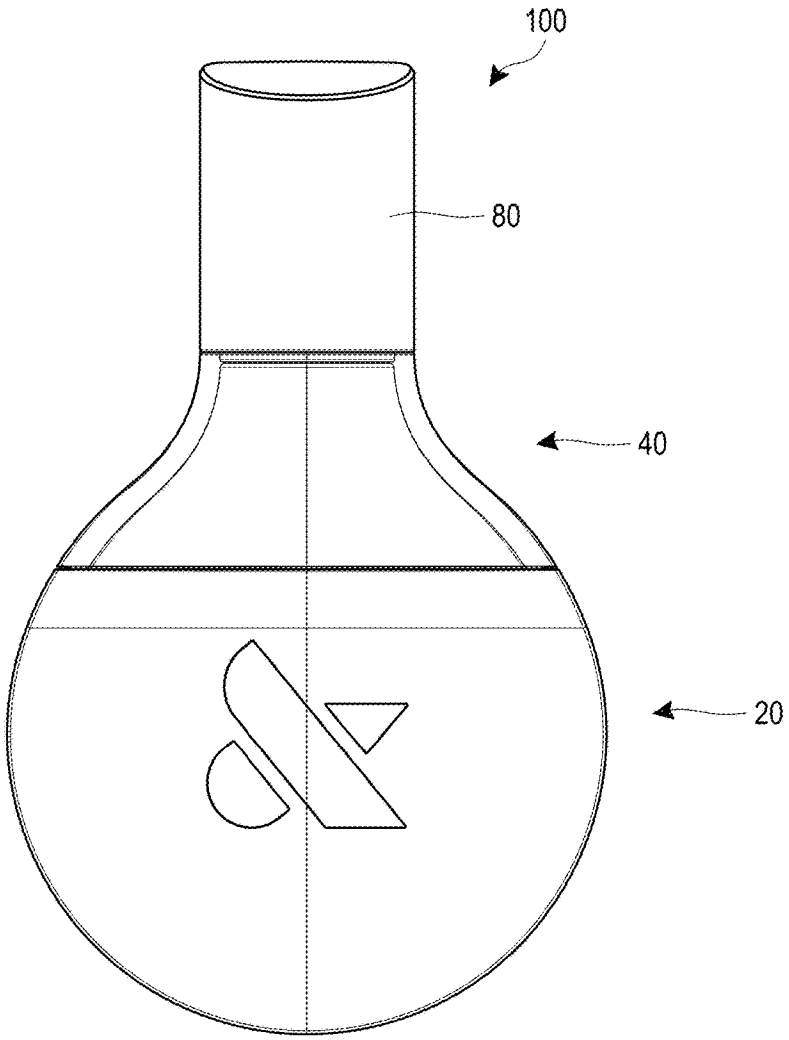
FIG. 3 is a schematic bottom view of a device for applying or removing nail polish or nail art.
Figure 6:
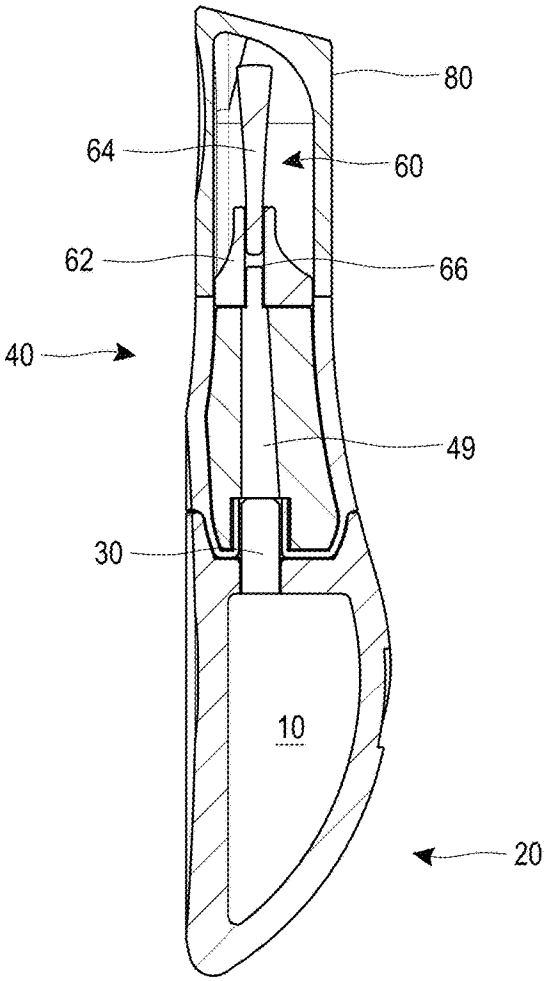
FIG. 6 is a schematic cross-sectional view of an assembled device for applying or removing nail polish or nail art.
Figure 5:
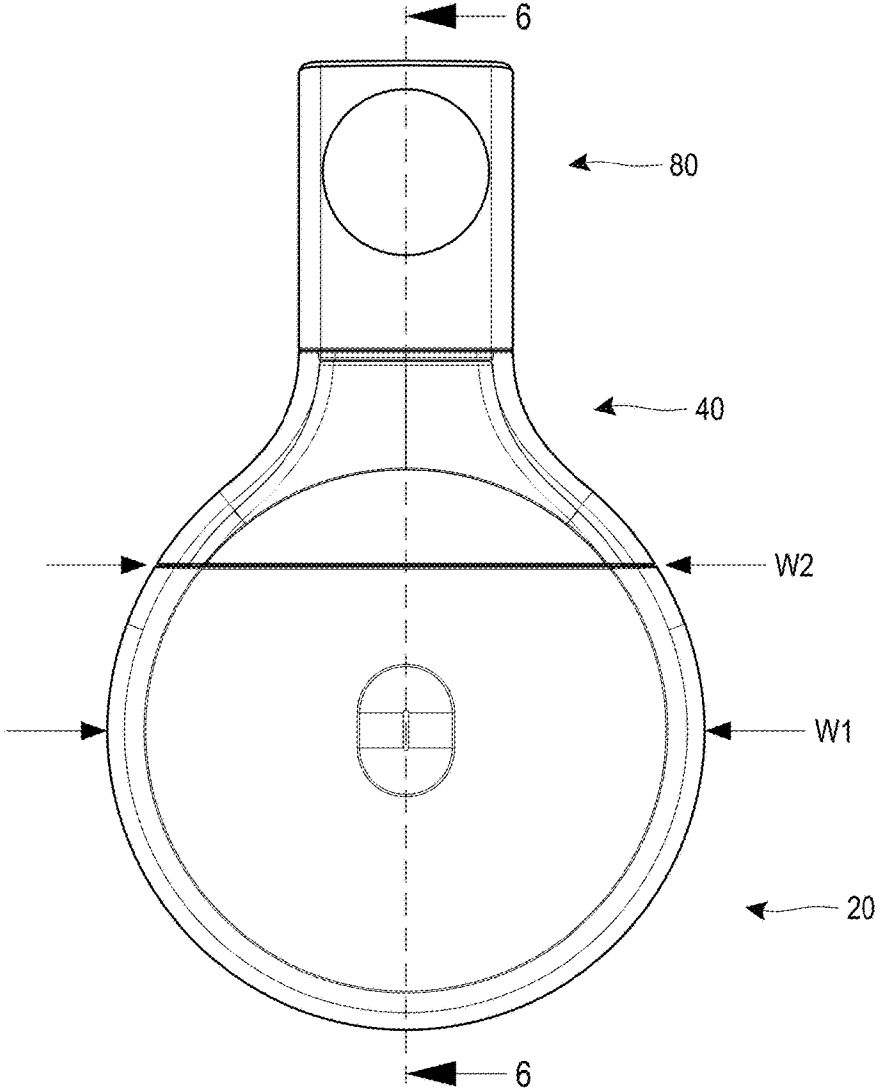
FIG. 5 is a schematic top view of a device for applying or removing nail polish or nail art.

With continued reference to FIGS. 1-8, the handle 40 optionally has a contoured body that extends from its proximal end 42 to its distal end 44. The handle 40 has a top surface 46, at least a portion of which is optionally contoured (e.g., concave) and has a contoured (e.g., convex or curved) bottom surface 48. Advantageously, the top surface 46 of the handle aligns with the top surface 26 of the cartridge 20 to provide a substantially continuous surface (e.g., a continuous surface that substantially defines a circular surface, as shown in FIG. 5). Similarly, the bottom surface 48 of the handle aligns with the bottom surface 28 of the cartridge to provide a substantially continuous surface (e.g., a continuous surface that substantially defines a domed surface, as shown in FIGS. 3-4). Accordingly, when assembled together, the cartridge 20 and handle 40 advantageously provides a contoured body that is easy and comfortable for the user to hold (e.g., while applying nail polish to a nail of the user or a different person) and the junction or transition between the cartridge 20 and handle 40 is substantially smooth to inhibit discomfort to the user or potentially cause the user to inadvertently push or pry the handle 40 away from the cartridge 20, inadvertently decoupling them. As best shown in FIGS. 3 and 5, the cartridge 20 can have a maximum width W1 that is greater than a maximum width W2 of the handle 40. Optionally, the handle 40 has a conduit or flow path 49 that extends between the proximal end 42 and distal end 44 of the handle 40. The conduit or flow path 49 substantially aligns with the flow control member 30 of the cartridge 20 to receive liquid from the reservoir 10 therethrough. Accordingly, once the cartridge 20 is coupled to the handle 40, the liquid in the reservoir 10 can flow to the distal end 44 of the handle 40 via the conduit or flow path 49.

With reference to FIG. 7, the applicator head 60 optionally includes a support body 62 attached to the distal end 44 of the handle 40, and an applicator implement 64 attached to the support body 62.

Figure 8:
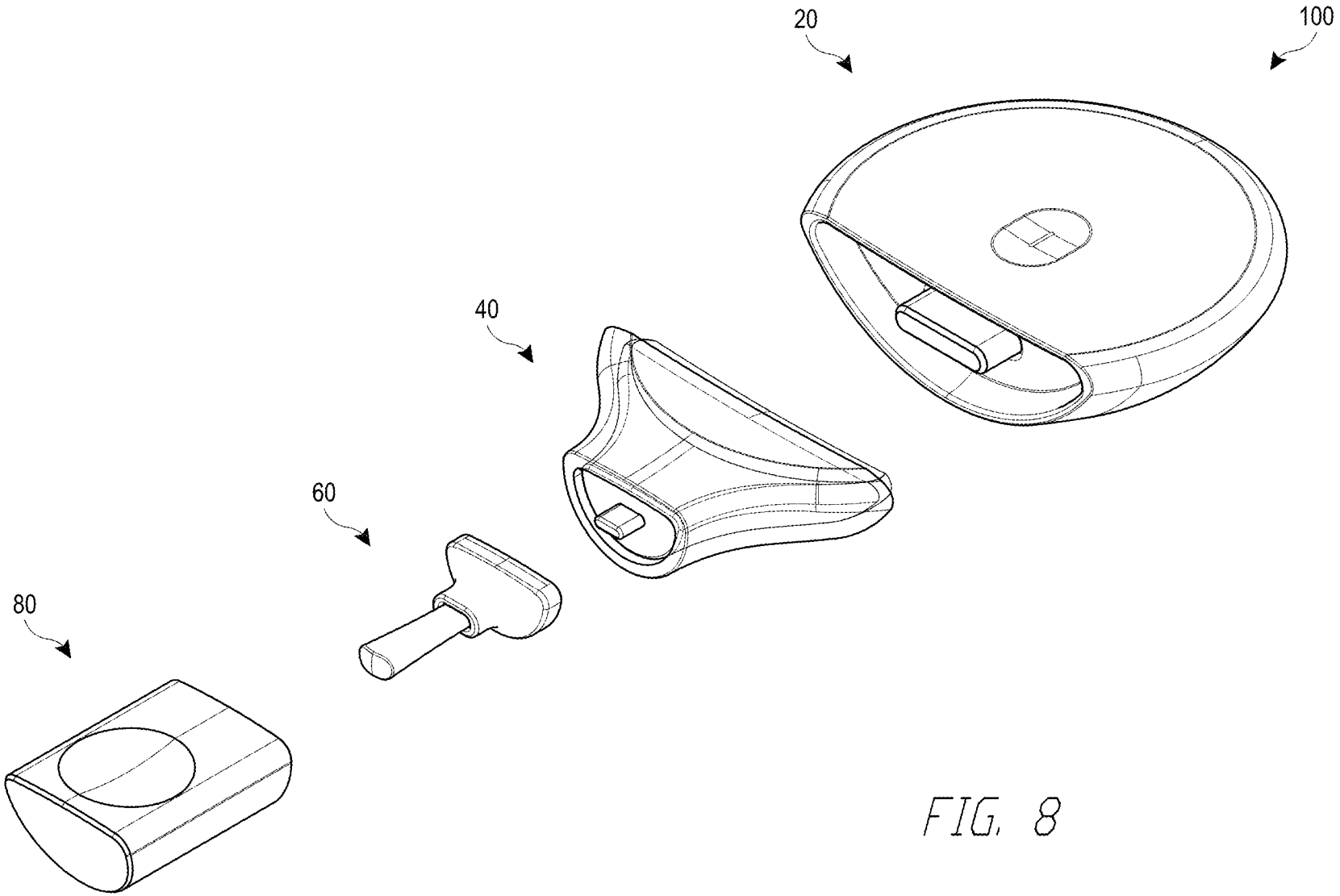
FIG. 8 is a schematic perspective exploded view of a device for applying or removing nail polish or nail art.

Optionally, the applicator head 60 can be removably coupled to the distal end 44 of the handle 40 (as shown in FIG. 8), allowing different applicator head 60 (e.g., having different types applicator implements 64, different widths of applicator implements 64, different lengths of applicator implements 64, etc.) to be coupled to the handle 40 to customize the device 100 and its operation. Optionally, the head 60 removably couples to the handle 40 via a press-fit connection. In another variation, the head 60 can removably couple to the handle 40 via a threaded connection. In still another variation, the head 60 can removably couple to the handle 40 via a key-slot connection. In still another variation, the head 60 can removably couple to the handle 40 via a snap-fit mechanism; for example, one of the distal end 44 of the head 40 and the support body 62 can have a ridge or protrusion that snaps or clips into a groove or recess on the other of the distal end 44 of the head 40 and the support body 62.

In FIG. 7, the applicator implement 64 is a brush having a plurality of bristles. In another variation, the applicator implement 64 is a sponge. However, the applicator implement 64 can have other forms (e.g., a pen, a stamper tip for applying stamped designs, a striper tip for applying stripes, a dotter tip for applying dots) that can optionally be removably coupled to the distal end 44 of the head 40 as desired to allow a user to create (e.g. draw) nail art designs on their finger or toe nails. In some variations, the applicator head 60 can be interchanged while the cartridge 20 is loaded (e.g., coupled) to the handle 40. In other embodiments, the applicator head 60 can be interchanged prior to coupling a cartridge 20 to the handle 40.

The applicator head 60 can have a conduit or flow path 66 (See FIG. 6) that extends through the support body 62 to the applicator implement 64. The conduit or flow path 66 substantially aligns with the conduit or flow path 49 in the handle 40, so that the liquid (e.g., nail polish, nail art, nail polish remover) that flows through the handle 40 from the reservoir 10 flows to the applicator implement 64 (e.g., brush, sponge) via the conduit or flow path 49 in the handle and the conduit or flow path 66 in the applicator head 60. Accordingly, once the cartridge 20 is coupled to the handle 40, and the flow control member 30 is actuated as described above, the liquid in the reservoir 10 can flow to the applicator implement 64 for application by the user (e.g., to a finger or toe nail).

Figure 9:
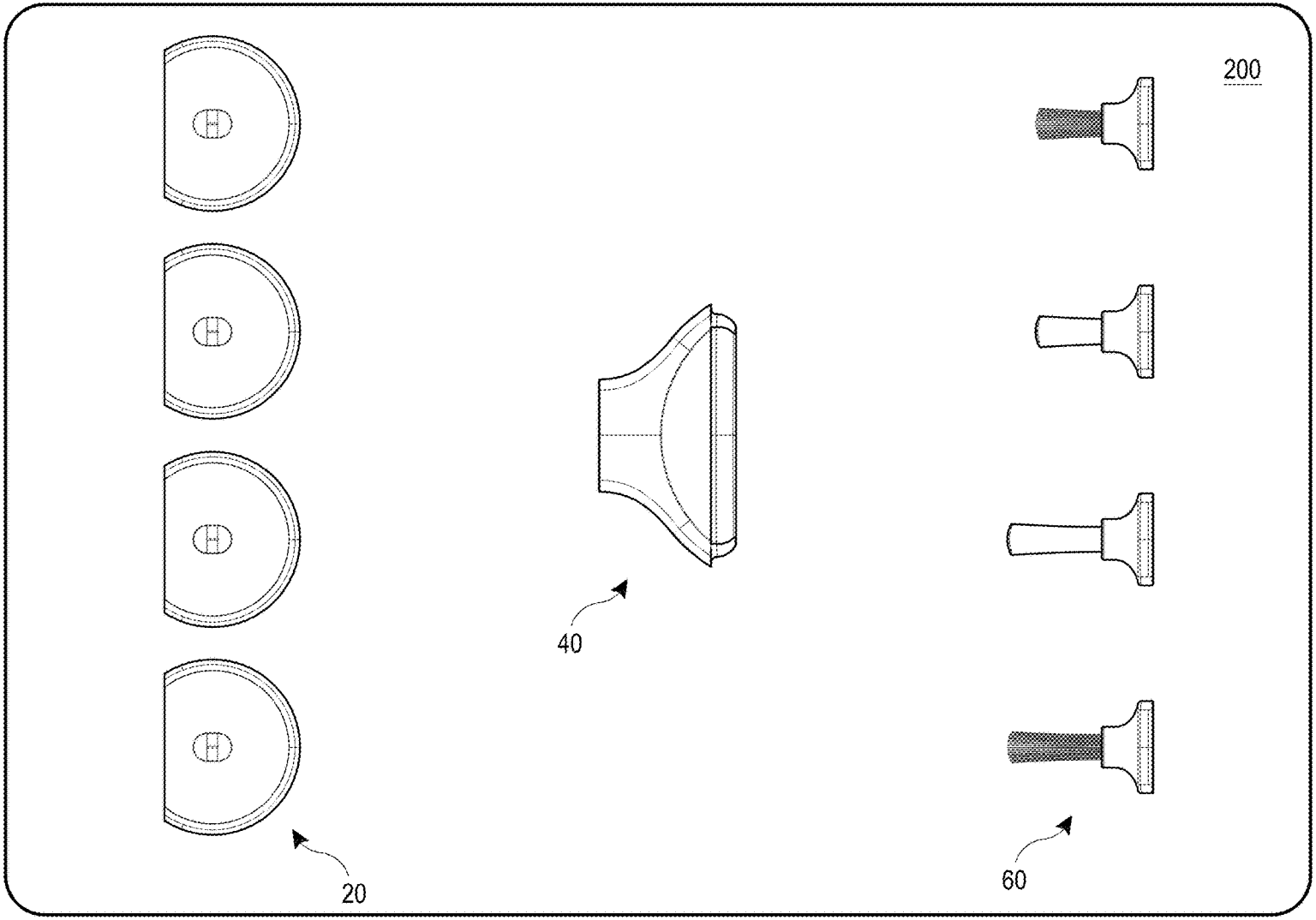
FIG. 9 is a schematic view of a kit for applying or removing nail polish or nail art.

FIG. 9 shows one embodiment of a kit 200. The kit 200 can include a case with one or more cartridges 20, each having a different fluid (e.g., color nail polish, nail polish remover, nail art) in its reservoir 10, one or more handles 40, and one or more applicator heads 60 with at least two different applicator implements 64 (e.g., sponges, brushes, pens, stamper, dotter, stripper). In some variations, the kit 200 can have only cartridges 20, or only applicator heads 60. A user can then assemble the device 100 by coupling one of the cartridges 20 and one of the applicator heads 60 to the handle 40 to assemble the applicator devices 100, such as the applicator devices described above. The kit can also include one or more (e.g., a plurality) of cartridges 20.

Advantageously, the removable and replaceable cartridges 20 allow the user to utilize a variety of different nail polishes utilizing the same handle 40 and/or applicator head 60 to creatively apply different designs to a finger or toe nail in one sitting, therefore making the process more efficient and avoiding stains (e.g., from dripping nail polish in conventional nail polish bottles). Additionally, the system described herein advantageously allows the user to readily couple and decouple different cartridges (having different color nail polish or art, such as glitter) with a handle having different applicator implements (e.g., brush tip, sponge tip, stamper tip, striper tip, dotter tip) in one sitting to apply complex creative designs to a user's nails, making the process more efficient. In one variation, different applicator implements can be removably coupleable to the handle, so that the user can customize the applicator device utilizing different applicator implements and different cartridges as required by the desired nail art design.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A device for applying or removing nail polish or nail art on a finger or toe nail, comprising:

a handle;

a chamber removably coupled to the handle, the chamber configured to receive a volume of liquid chosen from a group consisting of nail polish or nail polish remover; and an applicator head attached to a distal end of the handle and having an applicator implement at a distal end of the applicator head, the applicator head having a flow path that extends through the applicator head to the applicator implement and is in fluid communication with the volume of liquid so that the liquid flows through the applicator head to the applicator implement, wherein selective actuation of the chamber by a user allows the liquid to flow out from the chamber and through the applicator head to the applicator implement for application of the liquid by the user to the finger or toe nail, wherein the handle and the chamber form a continuous contoured top surface comprising a concave surface extending from a proximal end of the chamber to the distal end of the handle, the concave surface configured to receive a user's finger thereon, wherein the handle and the chamber form a continuous contoured bottom surface comprising a convex surface extending from the proximal end of the chamber to the distal end of the handle, the convex surface configured to receive one or more user's fingers thereon, wherein the continuous contoured top surface and the continuous contoured bottom surface have a circular profile when viewed in top plan view.

2. The device of claim 1, further comprising a valve that selectively allows flow of the liquid through the applicator head to the applicator implement.

3. The device of claim 1, wherein selective actuation of the chamber comprises squeezing of the chamber.

4. The device of claim 1, wherein the applicator implement is chosen from a group consisting of a brush, a sponge, a pen tip, a stamper tip, a striper tip, and a blotter tip.

5. The device of claim 1, wherein the chamber has a maximum width that is greater than a maximum width of the applicator head.

6. The device of claim 1, wherein the applicator head is removably coupleable to the distal end of the handle.

7. A device for applying or removing nail polish or nail art on a finger or toe nail, comprising:

a handle;

a chamber removably coupled to the handle, the chamber configured to receive a volume of liquid chosen from a group consisting of nail polish or nail polish remover;

an applicator implement operatively coupled to a distal end of the handle and having a flow path that extends from the volume of liquid positioned in the chamber to the applicator implement so that the liquid flows from the volume of liquid positioned in the chamber to the applicator implement; and a valve that selectively allows flow of the liquid from the volume of liquid positioned in the chamber to the applicator implement, wherein selective actuation of the chamber by a user allows the liquid to flow out from the volume of liquid positioned in the chamber through the valve and through the applicator implement for application of the liquid by the user to the finger or toe nail, wherein the handle and the chamber form a continuous contoured top surface comprising a concave surface extending from a proximal end of the chamber to the distal end of the handle, the concave surface configured to receive a user's finger thereon, wherein the handle and the chamber form a continuous contoured bottom surface comprising a convex surface extending from the proximal end of the chamber to the distal end of the handle, the convex surface configured to receive one or more user's fingers thereon, wherein the continuous contoured top surface and the continuous contoured bottom surface have a circular profile when viewed in top plan view.

8. The device of claim 7, wherein selective actuation of the chamber comprises squeezing of the chamber.

9. The device of claim 7, wherein the applicator implement is chosen from a group consisting of a brush, a sponge, a pen tip, a stamper tip, a striper tip, and a blotter tip.

10. The device of claim 7, wherein the applicator implement is part of an applicator head that is removably coupleable to the distal end of the handle.

11. A kit for applying or removing nail polish or nail art on a finger or toe nail, comprising:

a handle;

a chamber removably coupled to the handle, the chamber configured to receive a volume of liquid chosen from a group consisting of nail polish or nail polish remover, wherein the handle and the chamber form a contoured body with a continuous contoured top surface and a continuous contoured bottom surface, the continuous contoured top surface comprising a concave surface extending from a proximal end of the chamber to a distal end of the handle, the concave surface configured to receive a user's finger thereon, the continuous contoured bottom surface comprising a convex surface extending from the proximal end of the chamber to the distal end of the handle, the convex surface configured to receive a user's finger thereon, wherein the contoured body comprises a circular profile when viewed in top plan view; and one or more applicator implements, each applicator implement operatively coupleable to the distal end of the handle and having a flow path that extends through the applicator implement and is in communication with the volume of liquid positioned in the chamber so that the liquid flows from the volume of liquid positioned in the chamber and to the applicator implement, and wherein selective actuation of the chamber by a user allows the liquid to flow out from the volume of liquid positioned in the chamber and to the applicator implement for application of the liquid by the user to the finger or toe nail.

12. The kit of claim 11, wherein one or both of the handle and the one or more applicator implements include a flow control member that includes a one-way valve.

13. The kit of claim 11, wherein the applicator implement is chosen from a group consisting of a brush, a sponge, a pen tip, a stamper tip, a striper tip, and a blotter tip.

14. The kit of claim 11, wherein the one or more applicator implements is part of an applicator head that is removably coupleable to the distal end of the handle.

15. The kit of claim 14, wherein the one or more applicator implements are a plurality of applicator heads at a proximal end of the one or more applicator implements, each of the plurality of applicator implements are chosen from a group consisting of a brush, a sponge, a pen tip, a stamper tip, a striper tip, and a blotter tip.

* * * * *